United States Patent [19]

Jumer

[11] 4,290,867

[45] Sep. 22, 1981

[54] MEANS FOR AND METHOD OF PRODUCING SMOOTH ELECTRO-POLISHED SURFACES

[76] Inventor: John F. Jumer, 16 W. 131 Timber Trails Dr., Oak Brook, Ill. 60521

[21] Appl. No.: 163,982

[22] Filed: Jun. 30, 1980

[51] Int. Cl.[3] ..... C25F 3/16; C25F 7/00; C25D 21/00; C25D 17/04

[52] U.S. Cl. ..... 204/129.35; 204/224 M; 204/225; 204/237; 204/297 R

[58] Field of Search ..... 204/129.1, 129.35, 224 M, 204/224 R, 225, 237, 297 R

[56] References Cited

U.S. PATENT DOCUMENTS

| | | | |
|---|---|---|---|
| 3,305,470 | 2/1967 | Williams et al. | 204/225 X |
| 3,424,667 | 1/1969 | Frank | 204/237 |
| 3,506,559 | 4/1970 | Bonga | 204/225 X |
| 4,081,347 | 3/1978 | Becker | 204/224 R |
| 4,127,459 | 11/1978 | Jumer | 204/129.1 X |

*Primary Examiner*—Donald R. Valentine
*Attorney, Agent, or Firm*—Lockwood, Dewey, Alex & Cummings

[57] ABSTRACT

Means for and method of electro-polishing generally planar upright surfaces of relatively large areas on machine parts of various shapes and sizes. The means and method constitute improvements on the method and apparatus disclosed in my prior U.S. Pat. No. 4,127,459 dated Nov. 28, 1978. In a preferred embodiment the surface to be electro-polished is a pattern-free, directionless, abrasively finished metal surface. When such a surface is electro-polished in accordance with this invention the resulting polished surface is waveless, ripple-less and uniformly smooth in all directions so as to exhibit superior anti-stick and release properties. Such a surface is particularly suited for numerous purposes such as head box components for paper-making machines.

11 Claims, 7 Drawing Figures

MEANS FOR AND METHOD OF PRODUCING SMOOTH ELECTRO-POLISHED SURFACES

This invention relates generally to innovations and improvements in means for and method of electro-polishing flat or slightly curved upright surfaces of relatively large areas on machine parts of various shapes and sizes.

The present invention may be viewed as an improvement on my prior invention shown and described in my U.S. Pat. No. 4,127,459 dated Nov. 28, 1978. The means or apparatus of my present invention are simpler in certain respects, and more adapted to handle a wide variety of various sized and shaped objects than are the method and the apparatus of U.S. Pat. No. 4,127,459. In addition, my present invention combines with the electro-polishing of a surface in an upright position, a pretreatment of the surface so as to provide a pattern-free, directionless, and abrasively finished surface.

The object of the invention, generally stated, is the provision of novel means for and method of electro-polishing flat or slightly curved upright surfaces of relatively large expanse on machine parts of various kinds, shapes and sizes and characterized by being practical, inexpensive, highly adaptable and flexible in respect to objects of varied size and shape, and capable of providing electro-polished surfaces characterized by being waveless, rippleless, and uniformly smooth in all directions so as to exhibit superior anti-stick and release properties.

Certain more specific objects of the invention will be apparent from the following detailed description of presently preferred embodiments of the invention taken in connection with the accompanying drawings wherein.

In addition to my above-mentioned U.S. Pat. No. 4,127,459, other aspects of the art of electro-polishing metal surfaces for industrial purposes are disclosed in my various prior patents, including U.S. Pat. Nos. 2,861,937, 3,616,341, 3,682,799, and 4,001,094 dated Nov. 25, 1968, Oct. 26, 1971, Aug. 8, 1972 and Jan. 4, 1977, respectively. Accordingly, reference may be had to these prior patents for additional information on the art of electro-polishing.

Figure 1:
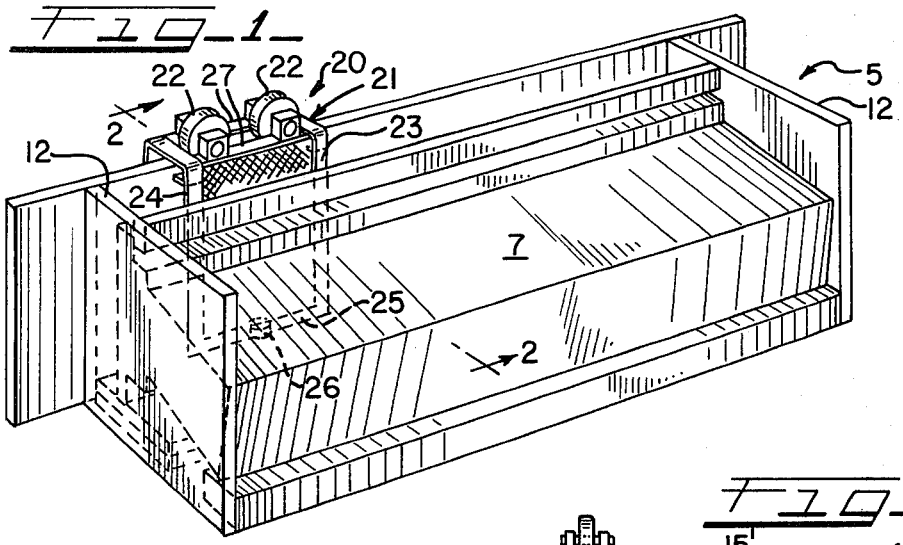
FIG. 1 is a perspective view of an apparatus in which an upright flat or slightly curved surface of a machine part may be electro-polished in accordance with one embodiment of the invention.
Figure 2:
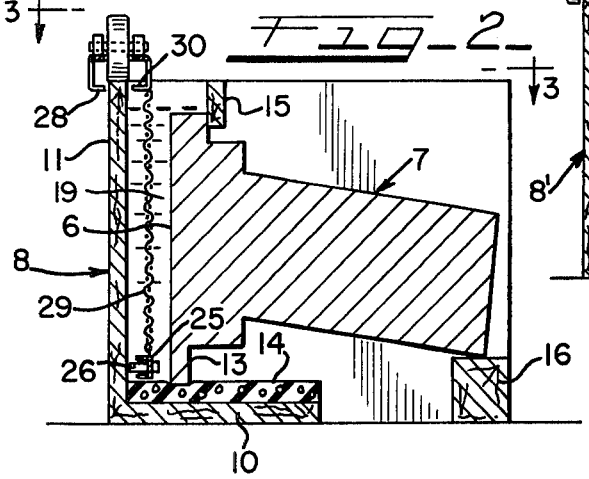
FIG. 2 is a vertical sectional view taken on line 2—2 of FIG. 1.
Figure 3:
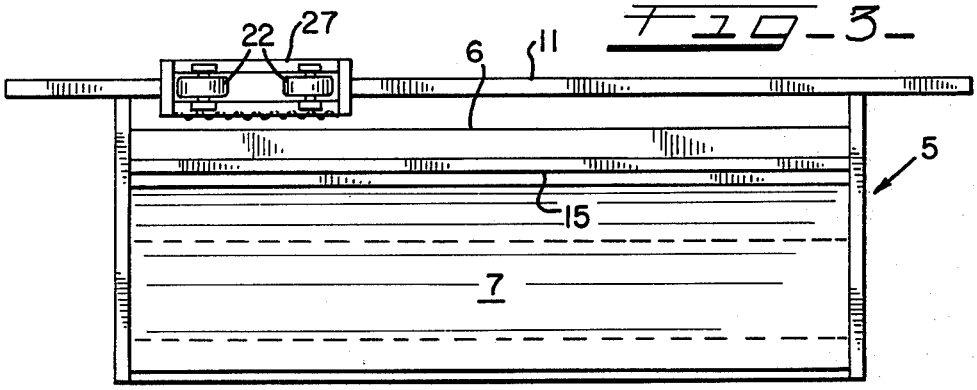
FIG. 3 is a top plan view of the apparatus shown in FIG. 1.

Referring to FIGS. 1-3, an apparatus or installation is indicated generally at 5 wherein the upright or vertical rectangular surface 6 of an irregularly-shaped machine part 7 can be conveniently electro-polished. The apparatus 5 comprises an elongated L-shaped member 8 having its horizontal bottom leg 10 resting on a level support surface and its upstanding leg 11 of such a height as to extend somewhat above the vertical surface 6 to be electro-polished.

A pair of end members 12—12 extend at right angles from the vertical leg 11 a distance which is at least sufficient to block off or close the space between the ends of surface 6 and the inner surface of the upright leg 11. The end walls 12 are positioned against the opposite ends of the machine part 7 and, if desired, the vertical lines of intersection between the opposite vertical edges of the surface 6 and the inner surfaces of the end walls 12—12 may be caulked or otherwise sealed so as to make them liquid-tight.

The bottom edge 13 of the machine part 7 adjacent the vertical surface 6 rests on a strip 14 of resilient, rubber-like dielectric material which covers at least part of the top surface of the horizontal leg 10. The weight of the machine part 7 is such that the edge 13 slightly compresses or indents the material 14 so as to provide a liquid-type seal or joint therebetween.

Preferably, a strip of dielectric material 15 is secured to an upper portion of the machine part 7 adjacent the top of the vertical surface 6 so that a polishing bath 16 of known composition filling the chamber between the surface 6 and the inner surface of the upstanding leg 11 can extend somewhat above the top of the surface 6.

Since the machine part 7 is irregularly shaped and the flat surface 6 needs to be substantially vertical for best results, the outer end of the machine part 7 is supported on a block 16 of suitable dimension as shown in FIG. 2.

A traveling or movable cathode assembly indicated generally at 20 is mounted on the vertical leg or wall 11 so that the surface 6 may be electro-polished in increments. The cathode assembly 20 comprises a suitable frame 21 which is supported by a pair of rollers 22 which ride on the top horizontal edge of the leg 11. The frame 21 also includes two vertically extending members 23 and 24 interconnected at the bottom by a cross-member 25. The active portion of the cathode in the form of a conductive wire mesh screen 29 is supported between the frame members 23, 24 and 25 as shown. In order to space the lower cross-member 25 of the cathode assembly 20 the desired distance from the leg 11, the horizontal frame member 25 carries a roller 26.

The frame 21 of the cathode assembly 20 also includes horizontal portions which extend over the top of the leg 11 and assist in mounting the rollers 22 on laterally-extending interconnecting members 27. The frame 21 includes in-turned flanges 28 and 30 (FIG. 2) which slidably engage opposite sides of the leg 11 adjacent its top edge so as to guide the cathode assembly 20 as it travels along the top edge of the vertical leg 11.

The cathode assembly 20 is given a negative charge in known manner by connecting it with a flexible terminal or connector while the machine part 7 is given a positive charge. The applied voltage is such that the proper current density is obtained depending upon the particular conditions and set-up. These conditions and operating details are well-known to those skilled in the art and do not form part of the present invention. The cathode assembly 20 may be intermittently moved in a series of steps from one end of the surface 6 to the other so as to completely electro-polish the vertical surface 6. Alternately, the cathode assembly 20 may be continuously moved at a pre-determined slow speed so as to polish the surface 6 in that manner. It will be apparent that one or more passes of the cathode 20 can be made as desired.

Since the surface 6 is upright or vertical, gas bubbles which normally form thereon due to the electro-polishing action tend to readily release and rise to the top of the bath and escape therefrom. The bubbles tend to release and rise while they are still small and thereby they do not interfere with the uniform electro-polishing action. It has been found that this release of the bubbles is promoted and superior electro-polishing results are obtained when the surface 6 is prepared in a manner that provides it with a pattern-free, directionless, abrasively finished surface. Such a surface can be obtained by using known commercial orbital or vibrating sanders provided with suitable abrasive cloth or surfaces. Such tools operate against a surface to be finished with a random, non-directional movement and the resulting surface is particularly adapted for electro-polishing in accordance with this invention. For example, such a resulting surface is especially useful in the head box of a paper-making machine where extreme smoothness allows the paper stock to flow smoothly with complete absence of waves or ripples. Abrasive finishing by other techniques, such as by use of rotary or belt polishers, do not yield surfaces which are similarly pattern-free and directionless. Consequently, when electro-polished according to this invention, these other finished surfaces tend not to be as smooth and effective.

Figure 4:
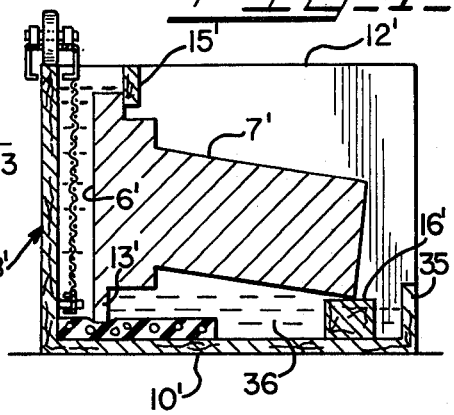
FIG. 4 is a vertical sectional view similar to FIG. 2 showing another embodiment of the invention.

In FIG. 4, a modification is shown wherein the lower leg 10' of the elongated L-shaped member 8 of FIGS. 1–3 is extended or lengthened and provided with a relatively short upstanding wall 35 at its outer end. The apparatus or installation of FIG. 4 is particularly suitable where, for one reason or another, it is difficult to prevent leakage of the electrolyte bath from the elongated, narrow vertical chamber between the vertical surface 6 and the leg 11. The leakage can be confined to the shallow depth indicated at 36 and maintained at that level by means of a small circulating pump which operates either continuously, or intermittently, in known manner to prevent build-up of excess solution from underneath the machine part 7 and re-introduce it into the main bath.

In the embodiments shown in FIGS. 1–4, the L-shaped members 11 and 11' and the end walls 12—12 and 12'—12' are indicated as being made of wood. Wood is an economical material to use, particularly for installations which will receive little or no repeat usage. However, these members could be formed of metal coated with a dielectric material.

Figure 5:
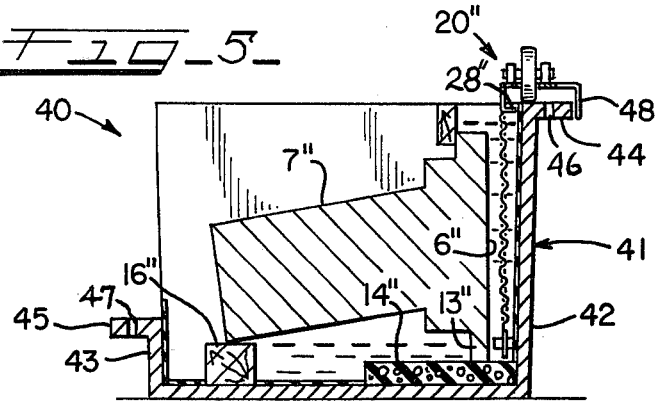
FIG. 5 is a vertical sectional view similar to FIGS. 2 and 4 showing still another embodiment of the invention and taken on line 5—5 of FIG. 6.
Figure 6:
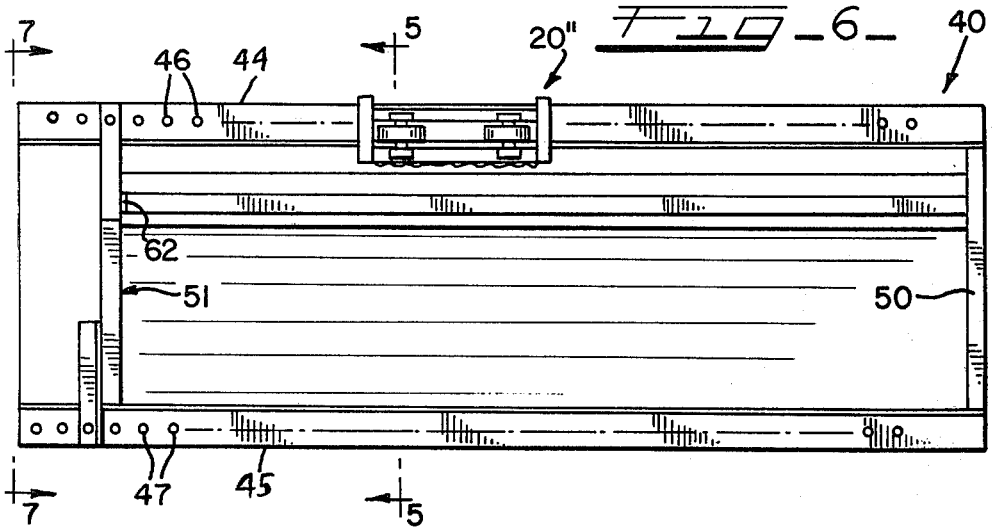
FIG. 6 is a top plan view of the apparatus shown in FIG. 5.
Figure 7:
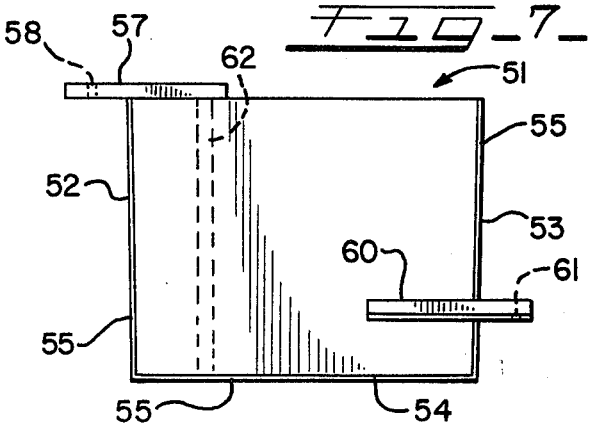
FIG. 7 is a side elevational view of the outer side of a movable end wall for the apparatus of FIGS. 5 and 6 and taken on line 7—7 of FIG. 6.

The embodiments of FIGS. 1–4 do not lend themselves to the repetitive electro-polishing operations or electro-polishing of vertical surfaces on irregularly or variously shaped bodies of differing lengths. In FIGS. 5–7, an embodiment is shown which is particularly suited for handling members of varying lengths, the apparatus being indicated generally at 40. This apparatus includes an elongated L-shaped body or member 41 which, because of its permanence and adaptability for re-use, will ordinarily be formed of metal and coated with a dielectric material. For a purpose to be discussed below, the upstanding leg 42 of member 41 and the shorter upstanding outboard leg 43 are tapered outwardly slightly instead of being perfectly perpendicular or vertical. Out-turned flanges 44 and 45, respectively, extend along the tops of the legs 42 and 43. These flanges 44 and 45 are apertured at regular intervals as indicated at 46—46 and 47—47 for a purpose to be described.

A machine part or object 7'' having an elongated, vertically oriented surface 6'' to be electro-polished is shown positioned in the apparatus 40. The bottom edge 13'' rests on a strip of resilient rubber-like material 14'' while the outboard edge rests on a block 16'' of such a height that the surface 6'' is substantially vertical. A movable or traveling cathode assembly 20'' is mounted on the top of the vertical leg 42. However, because of the presence of the out-turned flange 44, there is no in-turned flange corresponding to in-turned flange 28 (FIG. 2). Instead, there is a modification to provide a vertically depending finger 48 (FIG. 5) which slides along the outer edge of the flange 44.

The right-hand end of the installation or apparatus 40, as shown in FIG. 6, is closed by a permanently installed end wall 50 against which the machine part or object 7'' will be placed with suitable sealing at that end of the narrow vertical chamber formed between the surface 6'' and the opposing surface of the vertical leg 42. The opposite end wall indicated generally at 51 is specially constructed so as to be shiftable in the L-shaped member 41. This ability to shift the end wall 51 permits the apparatus 40 to be used in the electro-polishing of vertical surfaces on objects or machine parts of varying lengths. The end wall 51 is formed of a generally rectangular piece of sheet material with the opposite side edges 52 and 53 thereof slightly tapered in an upward and outward direction so as to mate with the taper on the upstanding legs 42 and 43 of the L-shaped member 41. The opposite edges 52 and 53, as well as the bottom edge 54, are covered with a strip 55 of resilient rubber-like material such as weather-stripping. Accordingly, when the end wall 51 is set down into the L-shaped member 41 at different positions therealong, a fluid-tight seal will be formed between the opposite edges 52 and 53 and bottom edge 54 of the wall 51 and the mating inner surface of the L-shaped member 41.

In order to position the end wall 51 at various locations in the L-shaped structure 41, the end wall 51 is provided with a laterally-extending member 57 having a projecting or overhanging end of which is apertured as indicated at 58. A horizontally-extending angle member 60 is welded to the outer side of the end wall 51 at a height such that the horizontal leg of its apertured overhanging end will rest on the out-turned flange 45. When the end wall 51 is positioned in the desired location in the L-shaped structure 41, pins or bolts can be dropped through the aperture 58 and a registering aperture in the flange 44 and through the aperture 61 in the angle member 60 and a registering aperture in the flange 45.

The inwardly facing side of the movable end wall 51 is provided with a vertical strip 62 of resilient rubber-like material so as to form a liquid-tight seal with the adjacent vertical edge of elongated vertical surface 6''.

I claim:

1. A method of electro-polishing an elongated flat or slightly curved surface on an object which comprises positioning the object with said surface being vertically oriented on the horizontal leg of an elongated L-shaped member formed of impervious material and having the horizontal leg covered by a strip of resilient rubber-like material at least in the area on which said object is supported when said elongated vertical surface is uniformly spaced a small distance from the upright leg of said L-shaped member, positioning said object on said L-shaped member so that said elongated vertical surface and the opposing surface of the upright leg of said L-shaped member define two elongated walls of a vertical elongated chamber for holding a polishing bath, closing the opposite ends of said chamber by providing end wall members thereat in liquid-tight relationship therewith, movably supporting cathode means on said upright leg with said cathode having a generally planar active portion depending into said chamber and said polishing bath therein in uniformly spaced relationship with said elongated vertical surface when moved to different positions in said chamber, conducting direct electrical current between said elongated vertical surface having a positive charge and said active portion of said cathode having a negative charge, and moving said cathode means between opposite ends of said chamber until said elongated vertical surface is electro-polished.

2. The method of claim 1 wherein said bottom horizontal leg of said elongated L-shaped member forms the bottom of a shallow pan in which liquid leaking from said polishing bath is collected and returned to said bath.

3. The method of claim 1 wherein at least one of said end wall members is movable and is positioned on said elongated L-shaped member to close the adjacent end of said vertical elongated chamber.

4. The method of claim 3 wherein one of said end wall members is permanently installed at one end of said elongated L-shaped member and the other end wall member is movable and one end of said object is positioned against said permanent end wall and said movable end wall is positioned against the opposite end of said object.

5. The method of claim 1 wherein said elongated flat or slightly curved surface has been prepared for electropolishing by being provided with a pattern-free, directionless, abrasively finished surface.

6. Apparatus for electro-polishing an elongated flat or slightly curved surface on an object, said surface being disposed in a vertical position which comprises, an elongated L-shaped member, a strip of resilient rubber-like material extending along the top of the lower horizontal leg of said L-shaped member and providing a liquid-tight seal with bottom edge of said object adjacent said elongated vertically disposed surface, a block disposed outwardly of said resilient strip and providing a bearing surface for said object when said elongated flat or slightly curved surface is vertically disposed and uniformly spaced a short distance from the upstanding leg of said L-shaped member, end walls closing off the opposite ends of the narrow vertical space between said surface and said upstanding leg so as to form a chamber for a polishing bath, and cathode means movably mounted on the upstanding leg of said elongated L-shaped member having an active portion paralleling said elongated vertical surface and having a horizontal dimension not more than a small fraction of said surface.

7. The apparatus of claim 6 wherein the bottom horizontal leg of said elongated L-shaped member extends under said object and has a short upstanding leg on its outer end so as to provide the bottom and one side of a shallow pan for collection of liquid leaking from said polishing bath.

8. The apparatus of claim 7 wherein said upstanding leg of said elongated L-shaped member and said short upstanding leg thereon each as a flange extending outwardly from its upper edge with regularly spaced apertures therein, at least one of said end walls being movable on said L-shaped member and has apertured outwardly extending projections resting on said respective apertured flanges, and fasteners extending through registering apertures in said projections and flanges.

9. The apparatus of claim 8 wherein at least one said upstanding leg of said elongated L-shaped member and said short upstanding leg thereon is outwardly tapered and the edge of said movable end wall which engages a tapered leg is correspondingly tapered.

10. The apparatus of claim 9 wherein the side edges and bottom edges of said movable end wall carry a strip of resilient rubber-like material for forming a liquid seal with the abutting inner surfaces of said elongated L-shaped member.

11. The apparatus of claim 8 wherein one of said end wall is movable and the other is stationary.

* * * * *